US005711708A

United States Patent [19]

Fischer

[11] Patent Number: 5,711,708

[45] Date of Patent: Jan. 27, 1998

[54] TWO CIRCUIT TIMER

[76] Inventor: Roger D. Fischer, 4572 County Rd. 214, Fulton, Mo. 65251

[21] Appl. No.: 544,939

[22] Filed: Oct. 18, 1995

[51] Int. Cl.[6] ..... A63F 9/00

[52] U.S. Cl. ..... 463/36; 327/393

[58] Field of Search ..... 463/36, 39, 43, 463/44; 273/447, 448; 327/285, 286, 392, 393, 401; 361/401, 160, 166, 168.1, 169.1

[56] References Cited

U.S. PATENT DOCUMENTS

| | | | |
|---|---|---|---|
| 3,876,950 | 4/1975 | O'Connor | 327/286 |
| 5,458,342 | 10/1995 | Hernandez | 273/447 |

OTHER PUBLICATIONS

SSAC Literature.

Shannon Literature.

*Primary Examiner*—George Manuel

*Attorney, Agent, or Firm*—Richard J. Grundstrom

[57] ABSTRACT

A two circuit timer that has a primary circuit that controls a first external load, a secondary circuit that controls a second external load, a timer that controls deactivation of the primary circuit to reset the first external load and to open the secondary circuit to deactivate the second external load, and an actuator that activates the timer and closes the secondary circuit to activate the second external load. The two circuit timer functions as a video game controller and has a cycle that is initiated by the actuator. The actuator can be a momentary contact push button, a coin actuator or accepter, a start button on a hand controller, a key pad or a key on a computer keyboard. The actuator starts the timer and closes contacts in the secondary circuit to allow the second external load to be activated. At a preselected timed interval the timer momentarily opens the primary circuit to deactivate the first external load. As the primary load is deactivated the secondary circuit also opens to deactivated the second external load. The primary circuit is only deactivated momentarily. The first external load is reactivated momentarily. The primary circuit holds closed the first primary circuit to allow the first external load to be continuously activated until the timer is reset and the cycle reinitiated. The secondary circuit is held open to hold the second external load in a deactivated mode until the actuator means is activated and the cycle begins again.

19 Claims, 3 Drawing Sheets

TWO CIRCUIT TIMER

BACKGROUND OF THE INVENTION

The present invention relates to a two circuit timer and more particularly to a timing device having a primary circuit that normally holds an external load closed but resets the load, by opening and closing the load circuit after a preset time initiated by the activation of a timer and having a secondary circuit that normally holds a second external load open until the timer is started.

Computer stores, retail stores, video rental stores, toy stores, and other outlets can and do sell or rent video games. These games are very popular, especially among the younger generation. These games are also getting very sophisticated and challenging. The various outlets for these games typically have one to several games on display for users to test the game. The displays attract attention to the game and allows games to be played or tested right in the stores before purchase.

Often however, once an individual gets on the controls, the individual gets intrigued by the game and spends an extended time playing the game. Customers playing for extended time can become a nuisance for store management and customers. Other customers waiting to play or try the game become frustrated because they can not get to the game and they leave without trying, buying or renting a game. While at the same time, the individual who monopolized the game does not necessarily purchase or rent the game.

The purpose of trying out the game is to allow parents an opportunity to view the game for content, violence and what not, and to allow the players an opportunity to experience the visual and sound effects, and the experience level required. This generally takes 3 to 8 minutes.

There are one shot timers designed to address this problem. The one shot timers allow game play for a preset time. At the end of the timing cycle the video game is switched off and a video player is tuned on, substituting the video player for the game. The video player typically displays unrelated video content on the game monitor. Most of the time, the videos being played do not attract attention to the game being display.

The problem with the one shot timers is that they do not display or promote the preview of the game the kiosk is designed to promote, unless the game is in actual play. Virtually all the video games on the market today have some sort of preprogrammed preview of the game. The preview is programmed into the game to provide an action packed display while someone is waiting to play. This can be used as a promotional activity to attract attention to the game. The one shot timers do not allow this preview to be displayed.

Accordingly, it is an object of the present invention to provide a two circuit timer adapted to reset a video game after a preset timer is initiated and to allow the preprogrammed preview to be displayed on the game monitor while the game is not being played. The two circuit timer of this invention has a primary circuit that resets the game to a beginning point to limit the time a user can play the game and the secondary circuit that disables the hand controllers to prevent play without initiation of the timer.

Another object of the present invention is to provide a two circuit timer constructed to provide a primary circuit to control a first external circuit, such as the control over resetting a video or computer game, and a secondary circuit that disables a second external load, such as a hand controller of the game, until initiated by a timer.

A further object of the present invention is to provide a two circuit timer adapted for limiting the time a user can play a video game on display in a video outlet. The invention demonstrated that the time a user plays the video game is limited to the preset time set on a timer of this invention. This allows the user enough time to test the game but at the same time limits the amount of time a game can be played without starting from the beginning. This allows other users to play the game because a single user can only play for a limited time before the game is reset.

Still another object of the present invention is to provide a two circuit timer that can allow a player to play a game for a preset time based upon the value input into an actuator. The actuator can be a coin accepter in which the addition of additional money allows additional time of play. This allows the owner to recoup money invested in the display.

SUMMARY OF THE INVENTION

To accomplish the foregoing and other objects of this invention there is provided a two circuit timer. The two circuit timer has a primary circuit that controls a first external load, a secondary circuit that controls a second external load, a timer that controls the primary and secondary circuits and an actuator means that starts the timer and closes the secondary circuit on the onset and momentarily opens the primary circuit and opens the secondary circuit when the time is complete.

The video game preview timer has a cycle initiated by the actuator being activated. This can be either a momentary contact push button, a coin actuator or other devices, or by signals generated by inputs into the video game or computer. The actuator means starts the timer and closes contacts in the secondary circuit to allow the second external load to be activated. At a preselected timed interval the timer momentarily opens the primary circuit to deactivate the first external load. As the primary load is deactivated, the secondary circuit also opens to deactivated the second external load. The primary circuit is reactivated to hold the fist external load closed. The primary circuit holds closed the first primary circuit to allow the first external load to be continuously activated until the timer is reset and the cycle reinitiated. The secondary circuit is held open to hold the second external load in a deactivated mode until the actuator means is activated and the cycle begins again.

These and other objects and features of the present invention will be better understood and appreciated from the following detailed description of the main embodiment thereof, selected for purposes of illustration and shown in the accompanying drawings.

DETAILED DESCRIPTION

Figure 1:
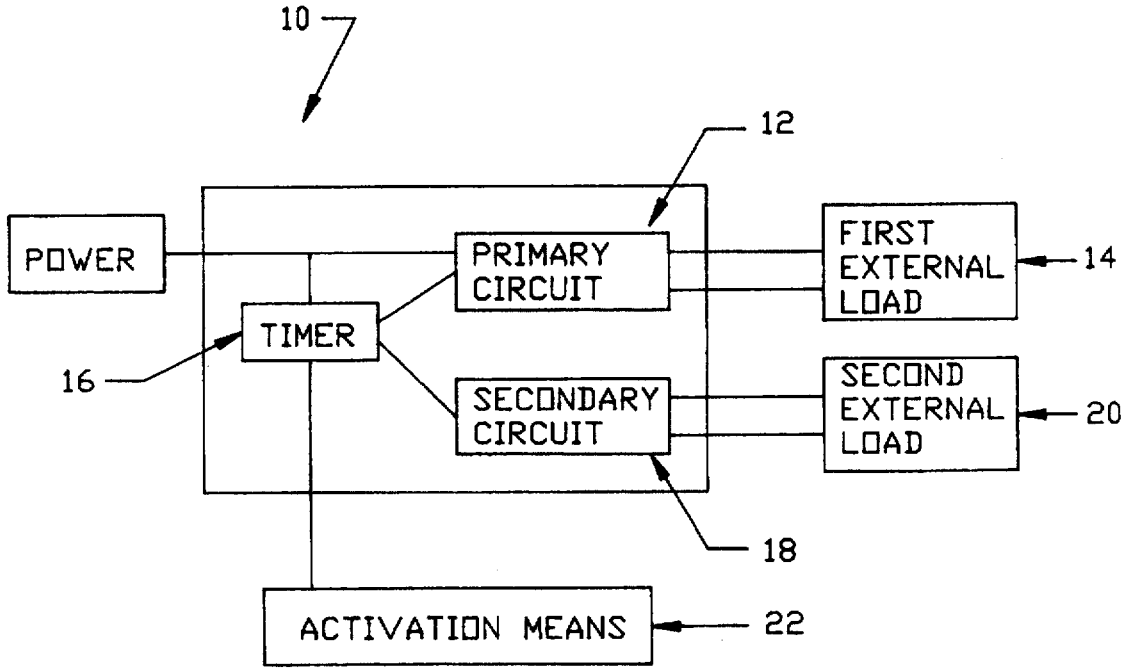
FIG. 1 is a block diagram showing various components and structure of the two circuit timer.

Referring to the drawings in general there is shown the preferred embodiment of the two circuit timer of this invention.

The two circuit timer 10, FIG. 1, generally has a primary circuit 12 that controls a first external load 14, a timer 16 controlling the length of time between activation and deactivation of the primary circuit 12, a secondary circuit 18 that deactivates a second external load 20 when the primary circuit is deactivated by the timer, and an actuator means 22 that starts the timer 16 and closes the secondary circuit 18 to activate the second external load 20.

Figure 2:
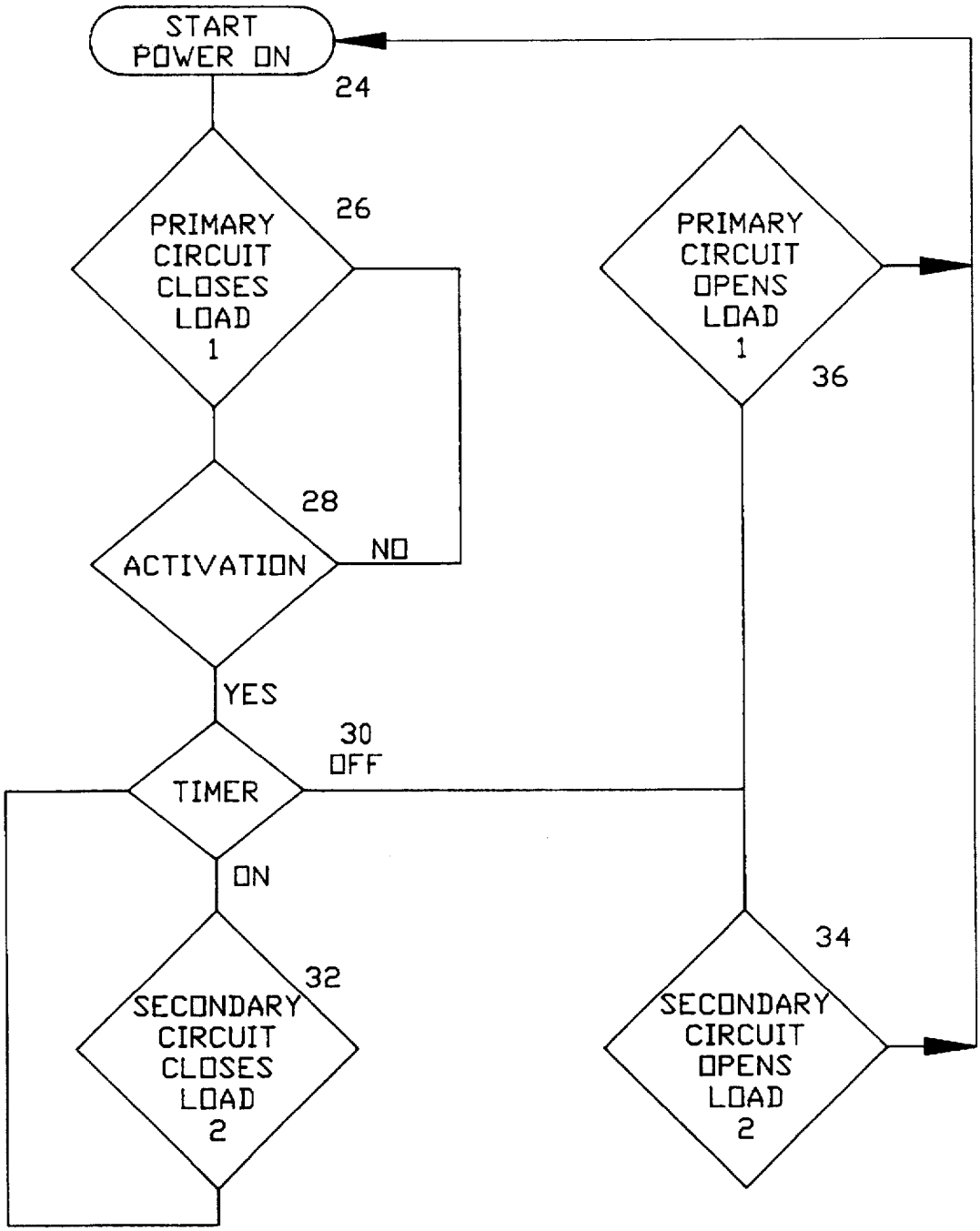
FIG. 2 is a flow chart showing the sequence of the preferred embodiment.

The two circuit timer 10 has a cycle, illustrated on flow chart FIG. 2, initiated by turning power on, step 24, to the two circuit timer 10. Power on, step 24, allows the primary circuit 12 to energize the first external load 14, step 26. The initiation of the actuator means 22, step 28, starts the timer 16, step 30, and closes contacts in the secondary circuit 18, step 32, to allow the second external load 20 to be activated. At a preselected timed interval, the timer 16 momentarily opens the primary circuit 12 to momentarily deactivate the first external load 14, step 36. As the primary load 14 is deactivated, the secondary circuit 22 also opens to deactivate the second external load 20, step 34. The primary circuit 12 is only deactivated momentarily which allows the first external load 14 to be reactivated or reset within a specified time, back to step 24. The primary circuit 12 holds closed the first external load 14 to allow continuous operation of the load until the timer 16 is reset and the cycle is reinitiated by the actuator. The secondary circuit 18 is held open to hold the second external load 20 in a deactivated mode until the actuator means 22 is activated and the cycle begins again.

The preferred embodiment and the best mode contemplated of the two circuit timer of the present invention are herein described. However, it should be understood that the best mode for carrying out the invention hereinafter described is offered by way of illustration and not by the way of limitation. It is intended that the scope of the invention includes all modifications that incorporate its principal design features.

Referring now to FIG. 1. The primary circuit 12 controls a momentary deactivation of the first external load 14. In one application, the first external load 14 is a video game. The first external load 14 is the power source to the game or if interconnected with a computer based game the game controlling circuit may be activated. As the primary circuit 12 momentarily deactivates the game by shutting off the power, the game is reset to a beginning point. Other loads such as computer based games could also be controlled in a similar manner. In another applications, the first external load 14 may control specific key functions on a keyboard or input a specific data change. It could also be used to control power to any other devices that is used and needs a two circuit timer such as disclosed herein.

The primary circuit 12, in the preferred embodiment, acts as a relay with controlling circuitry. The size and specific configuration of the controlling circuitry are determined by the particular application. Generally, the primary circuit 12 will be made up of integrated circuits, discrete components and a microprocessor. A timed relay may also be incorporated in specific applications. As the timer 16 completes the time set in the timer, a signal is sent to the primary circuit. The signal causes within the primary circuit a deactivation or opening of the controlling circuit for the first external load 14. The first external load 14 is reactivated after a short pause. The pause can be set by the management or user of the two stage timer. Generally, the pause will be approximately three seconds. This pause is to allow components in the first external load to be deenergized or turned off before reactivation. After the pause, the primary circuit 12 closes to allow activation of the first external load 14.

In the preferred embodiment, controlling primary power to a video game, as the first external load 14, the deactivation and the following activation by the primary circuit 12 resets the video game to the beginning of the game and allows the game's preprogrammed preview to be ran and displayed on the game monitor.

The secondary circuit 18 controls a second external load 20. In the preferred embodiment, the second external load 20 is the hand controller for the video game controlled by the primary circuit 12. The secondary circuit 18 controls activation and deactivation of the second external load 20. If the second external load 20 is a hand controller, the secondary circuit 18 may act as a simple relay or a series of relays controlled in parallel with specific controlling circuitry. As with the primary circuit 12, the specific components and size is determined by the application. In the most simple embodiment, a single relay with controlling circuitry is used. The single relay of this embodiment may control the power line feeding the hand controller. Without power to the hand controller, the hand controller will not function. In another embodiment, all lines between the game and the hand controller may be controlled. This completely disables the hand controller. The second external load could also be a computer game controlling piece or keyboard. In this embodiment, the second external load 20 is the controlling circuit to the computer controls for a computer based video game. The controlling circuit having the ability to lock out or allow the computer controls to be used in playing a computer based video game. The application of the two circuit timer of this invention can be very broad.

The secondary circuit 18 is controlled by one of two methods. The first method, the timer 16 controls all functions of the secondary circuit 18. In this embodiment, as the timer 16 is started the secondary circuit 18 is allowed to activate or close all circuits for the second external load 20. When the time on the timer 16 is ran out, or the timer 16 is off, the secondary circuit 18 opens or deactivated all circuits for the second external load 20.

In the second embodiment, the secondary circuit 18 is controlled by two functions. One function is from the primary circuit 12 and the second from the activation means 22. In this embodiment, the activation means 22 causes the secondary circuit 18 to close or activate all the circuits controlling the second external load 20. The timer 16 controls only the primary circuit 12 in this embodiment. When the primary circuit is momentarily deactivated at the end of the timer cycle, the secondary circuit 18 opens or deactivates circuits to deactivate the second external load.

In either case however, the second external load 20 is held in a deactive state by the secondary circuit 18 unless the timer 16 is started and counting down a specific time.

The timer 16 can be one of many different timers known in the art and in the industry. In the most simple embodiment, the timer 16 functions as a single on/off switch that toggles at a preset time. In another embodiment, the timer 16 is an adjustable timer 16 in which the preset time can be adjusted by the management or user of the two circuit timer 10 of this invention. Yet another embodiment, the timer 16 is an adjustable timer 16 in which the time is determined by input from another apparatus such as a coin accepter or money receiver.

The timer 16 is initiated by the activation means 22. Once initiated the timer is turned "on" and begins to count down the time. Once "on" the secondary circuit 18 is alerted to activate or close circuits for the second external load 20. When the time is up, the primary circuit 12 is signaled to deactivate, causing a momentary deactivation, and the secondary circuit 18 is signaled to deactivate or open circuits for the second external load 20. The timer 16 ends the cycle as discussed above.

The actuator means 22 in the most simple embodiment is a momentary contact push button. The actuator means 22 simply initiates the timer 16 and causes the secondary circuit to close or activate the second external load 20. The actuator means 22 can also be an optional actuator means 40 such as a coin or token accepter, a money accepter, a start button on a hand controller of a video game, a key on a keyboard, a key on a key pad, a debit card system or any other device or apparatus that can signal the timer 16. The actuator means 22 that incorporates a monetary input, may also control the amount of time on the timer 16. The time on the timer 16 is extended by the addition of additional monetary measurement, such as coins, tokens, debits, or paper money. The money or monetary accepter would send a signal to the timer 16, acting as the actuator 22, to activate the timer 16 and signals to extend the time based upon monetary inputs to actuator means 24. This arrangement provides management or users of the two circuit timer 10 better control over a game and the potential income. A token accepter allows best control by having management control the issuance of tokens.

The actuator means 22 can also be simple momentary contact push button and a monetary accepter connected in parallel. The momentary contact push button would be in a remote or enclosed location to be operated by management. The monetary accepter would be located for use by the players. This would allow management to give play time to specific persons and to allow testing and setup without having to input a monetary exchange.

Figure 3:
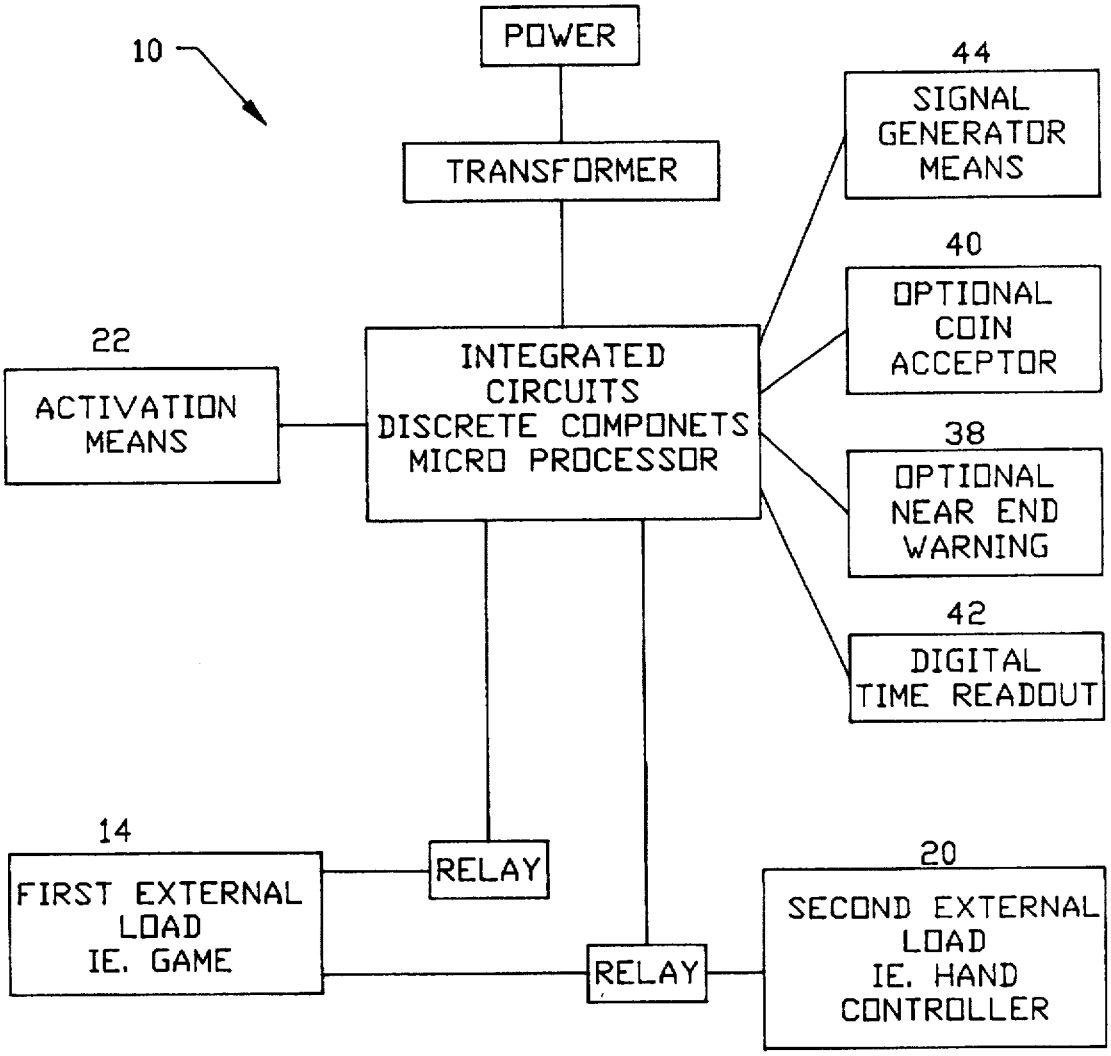
FIG. 3 is a block diagram showing an application to the two circuit timer of this invention.

In yet another embodiment, the actuator means 22 may receive signals from a signal generator 44, shown in FIG. 3. The signals from the signal generator 44 would be based upon the score or level achieved during play of the game. The signal generator means 44 may be internal or external to the two circuit timer 10. In this embodiment, additional time may be granted by having the signal generator means 44 send a signal to the timer 16 to extend the time at specific preset scores or levels.

Other options are also available on the two circuit timer 10 of this invention. A near end warning 38 may be used. The near end warning pre-warns a user the timer 16 is approaching the end of a preset time on the timer. This would allow a player to insert more or additional coinage or monetary measurement to extend the time of play. It also warns the player the game is about to end. The near end warning in one embodiment is a simple warning light located in an area observable by a user.

Another option is a digital time readout 42. The digital time readout 42 is used to display and count down the preselected time on the timer so a player can monitor play time. As the tome approached the end the player can insert additional monetary exchange to extend time if a monetary accepter is used.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. A two circuit timer comprising:

a primary timed circuit that controls activation and deactivation of a first external load;

a secondary circuit deactivated by said primary timed circuit, said secondary circuit controlling activating and deactivating a second external load;

a timer controlling a momentary deactivation of said primary timed circuit; and an actuator means that activates said timer and said secondary circuit to activate said second external load.

2. The two circuit timer as set forth in claim 1 in which said first external load is the controlling circuit on a video game having the ability to reset a video game to a beginning point and to allow a preprogrammed preview to be displayed on the video game monitor.

3. The two circuit timer as set forth in claim 1 in which said first external load is the controlling circuit on a computer having the ability to reset a computer based video game to a beginning point and to allow a preprogrammed preview to be displayed on the computer monitor.

4. The two circuit timer as set forth in claim 1 in which said second external load is the controlling circuit to a video game hand controllers, said controlling circuit having the ability to allow or disallow the hand controller use.

5. The two circuit timer as set forth in claim 1 in which said second external load is the controlling circuit to the computer controls for a computer based video game, said controlling circuit having the ability to lock out or allow the computer controls to be used in playing a computer based video game.

6. The two circuit timer as set forth in claim 1 in which said actuator means is a momentary push button switch.

7. The two circuit timer as set forth in claim 1 in which said actuator means is a coin actuator.

8. The two circuit timer as set forth in claim 7 in which said coin actuator controls the amount of time on said timer, the time on said timer being extended by the addition of additional coinage.

9. The two circuit timer as set forth in claim 1 in which said timer is a time adjustable timer.

10. The two circuit timer as set forth in claim 1 further comprising a near end warning that pre-warns a user said timer is approaching the end of a preset time on said timer.

11. The two circuit timer as set forth in claim 10 in which said near end warning comprises a warning light located in an area observable by a user.

12. The two circuit timer as set forth in claim 1 further comprising a signal generator means, said signal generator means sending a signal to said timer to extend time based upon input from a computer based game score or level achieved during play.

13. A two circuit timer comprising:

an actuator;

a secondary circuit activated by said actuator, said secondary circuit controlling a second external load;

a primary circuit that controls a first external load when said primary circuit is activated and deactivated; and a timer, said timer initiated by said actuator, said timer controlling the time interval at which said primary circuit is momentarily deactivated and at which said secondary circuit is deactivated, said secondary circuit being held in a deactivated mode until said timer and said secondary circuit is activated by said actuator.

14. The two circuit timer as set forth in claim 13 in which said actuator is selected from a group comprising a token accepter, a money accepter, a momentary contact push button, a start button on a hand controller of a video game, a key on a keyboard, a key on a key pad and a debit card system.

15. The two circuit timer as set forth in claim 13 further comprising a digital time readout, said digital time readout displaying and counting down the preselected time on said timer from a beginning point to the end so that a user can monitor play time remaining.

16. A two circuit timer comprising:

a primary circuit that controls a momentary deactivation and activation of a video game by controlling primary power to the video game, the deactivation and the following activation resets the video game to the beginning of the game and allows the game's preprogrammed play to be previewed on the game monitor;

a secondary circuit deactivated at the time when said primary circuit is deactivated, said secondary circuit controlling activation and deactivation of the control hand pieces of the video game and controlling the start of a game to be played;

an adjustable timer controlling a time interval at which said primary circuit is momentary deactivated to reset the video game and the time interval the secondary circuit is activated to control the length of play of the video game; and an actuator means that initiates said adjustable timer and activates said secondary circuit to activate the hand pieces to allow a user to play the video game for the preset time on said timer.

17. The two circuit timer as set forth in claim 16 in which said actuator is a momentary contact push button.

18. The two circuit timer as set forth in claim 16 in which said actuator is a money accepter, said money accepter controlling the length of time on said adjustable timer, the time on said timer being extended by the addition of additional coinage.

19. The two circuit timer as set forth in claim 16 further comprising a signal generator means, said signal generator means sending a signal to said timer to extend time based upon input from a computer based game score or level achieved during play.

* * * * *